United States Patent [19]

Jacobsson

[11] 3,993,258

[45] Nov. 23, 1976

[54] THREAD DELIVERY DEVICE, PARTICULARLY FOR TEXTILE MACHINES

[75] Inventor: Kurt Arne Gunnar Jacobsson, Ulricehamn, Sweden

[73] Assignee: Aktiebolaget IRO, Ulricehamn, Sweden

[22] Filed: Apr. 16, 1975

[21] Appl. No.: 568,713

[30] Foreign Application Priority Data

Apr. 19, 1974 Sweden ..... 7405274

[52] U.S. Cl. ..... 242/47.12

[51] Int. Cl.[2] ..... B65H 51/20

[58] Field of Search..... 242/47.12, 47.01, 47.13, 242/47.02, 47.03–47.011

[56] References Cited

UNITED STATES PATENTS

| | | | |
|---|---|---|---|
| 3,761,031 | 9/1973 | Pfarrwaller | 242/47.01 |
| 3,796,386 | 3/1974 | Tannert | 242/47.12 |
| 3,904,141 | 9/1975 | Rosen | 242/47.12 |

*Primary Examiner*—Richard E. Aegerter
*Assistant Examiner*—Willis Little
*Attorney, Agent, or Firm*—Woodhams, Blanchard & Flynn

[57] ABSTRACT

A thread delivery device, preferably for a textile machine, having a fixed drum with a rotatable hollow shaft. A thread from a storage bobbin is delivered from a first face of the drum through the shaft to a second face of the drum. A thread take-up member in the form of a circular take-up disc is rigidly mounted on the shaft adjacent the second face. A thread eyelet is arranged in the vicinity of the edge of the take-up disc for tangentially winding an intermediate supply of thread onto the drum. The intermediate thread supply is movable in the direction of the first face of the drum where the thread is drawn off the drum in the direction of and over the second face and fed to the working elements of the textile machine. An entire annular flange is arranged on the take-up disc, inside of the thread guide, which flange is perpendicular to the disc and projects towards the drum. The flange is concentric with the drum and the section thereof adjacent to the second face.

9 Claims, 5 Drawing Figures

THREAD DELIVERY DEVICE, PARTICULARLY FOR TEXTILE MACHINES

BACKGROUND OF THE INVENTION

The invention relates to a thread delivery device, preferably for textile machines, comprising a stationary drum with a rotatable hollow shaft whereby a thread from a storage bobbin is delivered from a first face to a second face on the drum where a thread take-up member in the form of a circular take-up disc is rigidly mounted, with a thread eyelet arranged in the vicinity of its edge, on the rotatable hollow shaft for the tangential winding of an intermediate supply of thread on to the drum, said take-up means being slidable in the direction of the first face of the drum where the thread is drawn off the drum in the direction of and over the second face and fed to the working elements of the textile machine.

Such a thread delivery device was recently brought on to the market. The thread eyelet on this device is in the form of a tube one end of which is secured in the take-up disc. Its length is adapted so that during take-up the thread passing through the tube is reliably delivered to the section of the drum provided for storing the thread. This known thread delivery device has the disadvantage that while being drawn off the drum the thread can run into the section between the take-up disc and the adjacent part of the drum and become twisted there in certain cases, particularly at the beginning or end of the drawing-off operation. This inevitably results in thread breakage and stoppage of the device. There is a particularly high risk of such an occurrence with elastic yarns, for example synthetic stretch yarns.

There is another known thread delivery device of the described type in which an eyelet or guide acting as a thread take-up member is rigidly mounted on a rotor which is rigidly connected to the hollow shaft. the rotor supports a cover and the bearing for a freely rotatable reversing pulley the maximum expansion of which occurs in a radial plane of the rotor. The thread is guided via this pulley between the exit from the hollow shaft and the point of entry into the thread eyelet. This known thread delivery device is costly to construct. As in the case of the already marketed device described above, there is the same risk with this device, namely, that part of the thread to be unwound from the drum may run back and pass between the drum and the edge of the rotor running around said drum.

The problem for the present invention is to provide a thread delivery device of the initially described type in which there are provided simple means of preventing the thread which is wound off the drum under tension from passing into the area between the take-up disc and the drum.

The problem is solved in accordance with the invention by arranging an entire annular flange, on the take-up disc inside the thread guide, perpendicular to the disc and projecting towards the drum, the said flange being concentric with said drum and the section adjacent to the second face.

The annular flange is a component which can be economically manufactured and mounted on the other disc, and its advantages have a dual function:

It overlaps the area of the drum next to the second face in such a manner that if any of the thread being drawn off should run back, it cannot pass between the drum and take-up disc. The thread is thus drawn off in a trouble-free manner. Moreover, the annular flange causes the thread being passed through the thread eyelet to be reliably delivered beyond the lower end of the drum to the area of the drum intended for take-up.

The intermediate section between the annular flange and the take-up disc or pulley can advantageously partially overlap the opening of the thread eyelet. The thread leaving the thread eyelet therefore passes directly on to the outer surface of the annular flange which serves as a thread guide.

The intermediate section leading from the annular flange to the take-up disc can be rounded, which improves guiding of the thread to be taken up over the outer surface of the flange and prevents damage.

The commercially available thread delivery device described at the beginning of the specification comprises a thrust ring which is mounted on the drum and tilted relative to the axis thereof for the axial displacement of the intermediate thread supply on the drum. The annular flange on this type of thread delivery device preferably has an internal diameter slightly in excess of the external diameter of the thrust ring. This means that the annular flange renders the area between the take-up disc and thrust ring largely inaccessible to both parts of the thread leaving the drum under tension which may run back and to the thread which extends from the thread eyelet to the take-up area of the drum.

In a preferred embodiment the take-up disc is provided, along its circumference, in a manner known per se with an annular outer flange extending perpendicular thereto and towards the drum, and the edge of the outer flange directed away from the take-up disc supports an inwardly tapering protective ring. The outer flange forms a division between the unwinding thread and the thread in the take-up area such that mutual entanglement of the two threads is eliminated. At the same time it diverts the thread to be taken up in the direction of the drum, particularly via the conical protective ring. In addition, the inside of the outer flange combines with the outside of the annular flange to define a space which, similar to the tubular thread guide of the already commercially available thread delivery device, effects trouble-free delivery of the take-up thread to the drum. However, this space provides the take-up thread with a greater cross-section of travel. This thread delivery device can therefore also be used for extremely coarse yarns, i.e. those of large cross-section, as well as for different types of effect yarns. The diameter of the tubular thread guide in the known thread delivery device would have to be increased for such purposes, but this would result in an increase in the diameter of the take-up disc and therefore an increased diverting angle for the threads to be taken up and wound off, as well as increased space requirement.

Practical embodiments of the invention are illustrated in the drawings.

DETAILED DESCRIPTION

Figure 1:
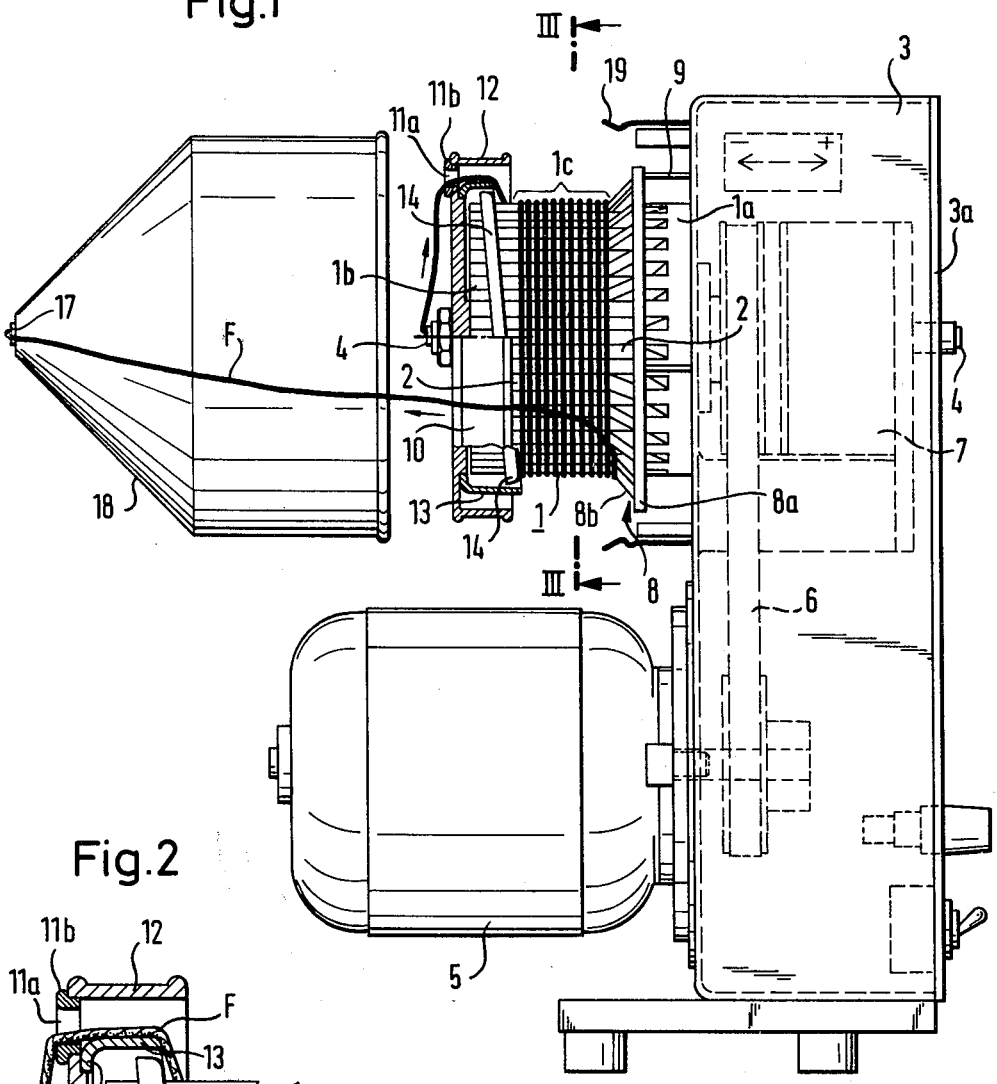
FIG. 1 shows a thread delivery device in side elevation and partial section.
Figure 4:
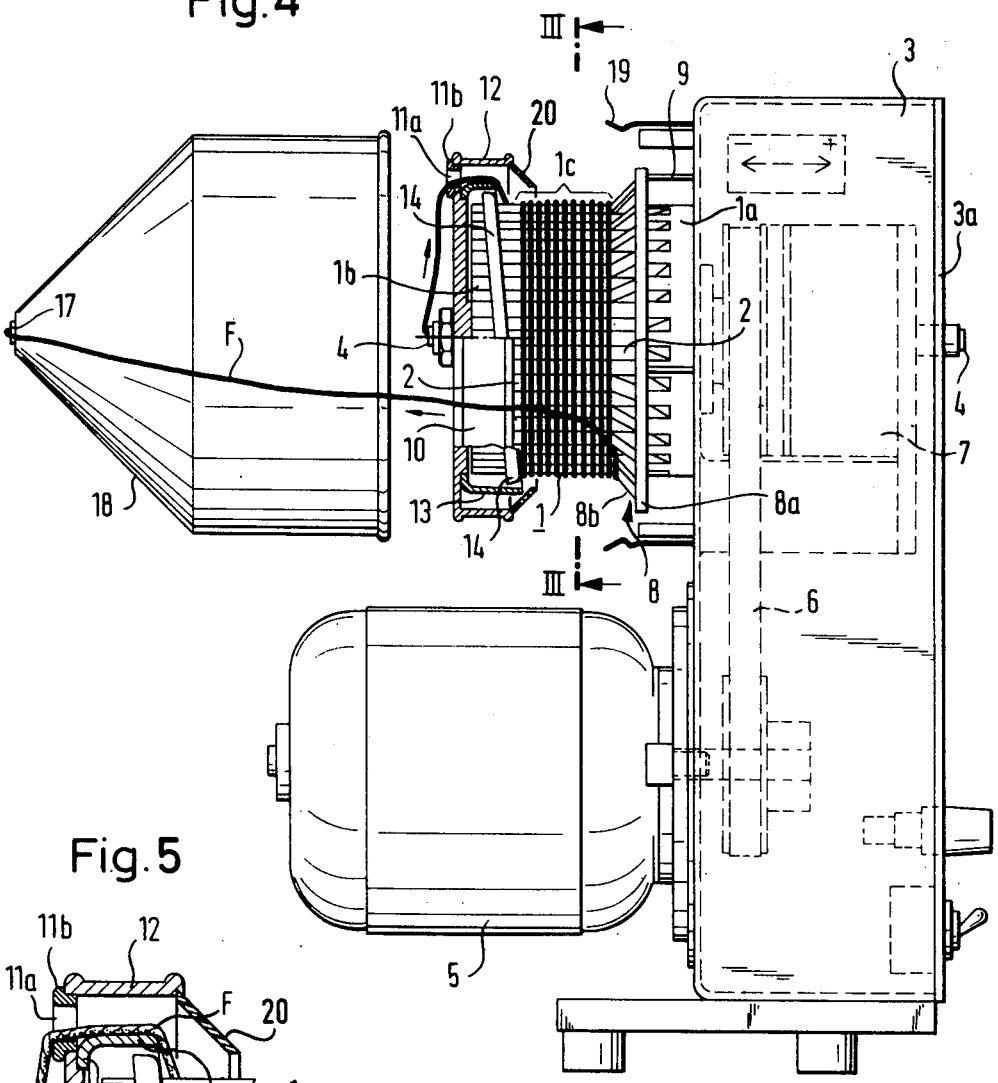
FIG. 4 shows a second embodiment of a thread delivery device in side elevation and partial section.

In FIG. 1 a cylindrical drum is generally designated by reference numeral 1, longitudinal slots 2 being arranged in the wall of said drum. One end 1*a* of the drum 1 is non-rotatably secured in a housing 3. A hollow shaft 4 extends from the free end 1*b* of the drum 1, axially through said drum as far as the face 3*a* of the housing 3 directed away from the drum. It is rotatably driven by means of an electromotor 5. In FIGS. 1 and 4 two elements for transmitting rotary motion are indicated by broken lines, namely a driving belt 6 and an electromagnetic clutch 7.

Figure 2:
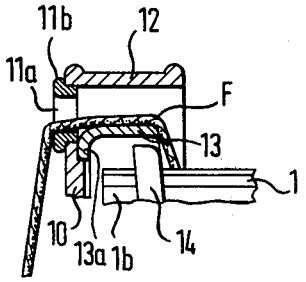
FIG. 2 is an enlarged section from FIG. 1.

A take-up disc 10 is rigidly mounted on the rotatable hollow shaft 4 at the drum end 1*b*, i.e. mounted so as to rotate with said hollow shaft. The circumference of said disc has a thread eyelet or guide 11*a* in the form of a circular recess lined with a sleeve-shaped insert 11*b*. Along its entire circumference the take-up disc 10 comprises an outer flange 12 which extends perpendicular to the disc surface towards the drum 1 in such a manner that it encloses a section of the drum adjacent to the take-up disc. An annular flange 13 is mounted on the face of the take-up disc 10 and is directed towards the drum coaxially with and parallel to the outer flange 12 in such a manner that the annular flange 13 slightly overlaps the thread eyelet 11*a*. The intermediate section 13*a* between the annular flange 13 and the take-up disc 10 is rounded (FIG. 2). The free edge of the flange 13 extends in a plane which is inclined relative to the principal plane of the take-up disc 10, the angle being equal to the inclination of a thrust ring 14 and the height of the annular wall being such that the flange 13 extends axially beyond the thrust ring 14 at all points.

The thrust ring 14 is rotatably mounted by means of a ball bearing 14*a* on a hub of the rotatable hollow shaft 4 inclined relative to the drum axis. Ring 14 has radial arms 15 (FIG. 3) which extend radially outwardly through the longitudinal slots 2 in the drum as far as a ring 16 which surrounds the drum wall and is integral with said radial arms.

A feeler 8 is arranged on the first end 1*a* of the drum next to the housing 3. It comprises a ring 8*a* surrounding the drum end, with teeth 8*b* which engage in the longitudinal slots 2 of the drum in such a manner that the feeler is longitudinally movable axially of the drum 1. The side of the ring 8*a* facing the housing 3 comprises supports or struts 9 which are mounted so as to be movable in the housing and spring-loaded. In this case the object of the spring force is to move the feeler 8 towards the second end 1*b* of the drum. One of the supports 9 is associated with an electric micro-switch for the supply of power to the electromagnetic clutch 7, which micro-switch can be actuated subject to the respective positions of the supports. The thread delivery device further comprises a protective hood 18 which encloses the drum and is shown in the raised position in FIGS. 1 and 4. In the part remote from the housing it is provided with an opening 17 which serves as an eyelet for drawing the thread off the drum. Fastening elements 19 for securing the protective hood around the drum are indicated on the housing 3.

Figure 3:
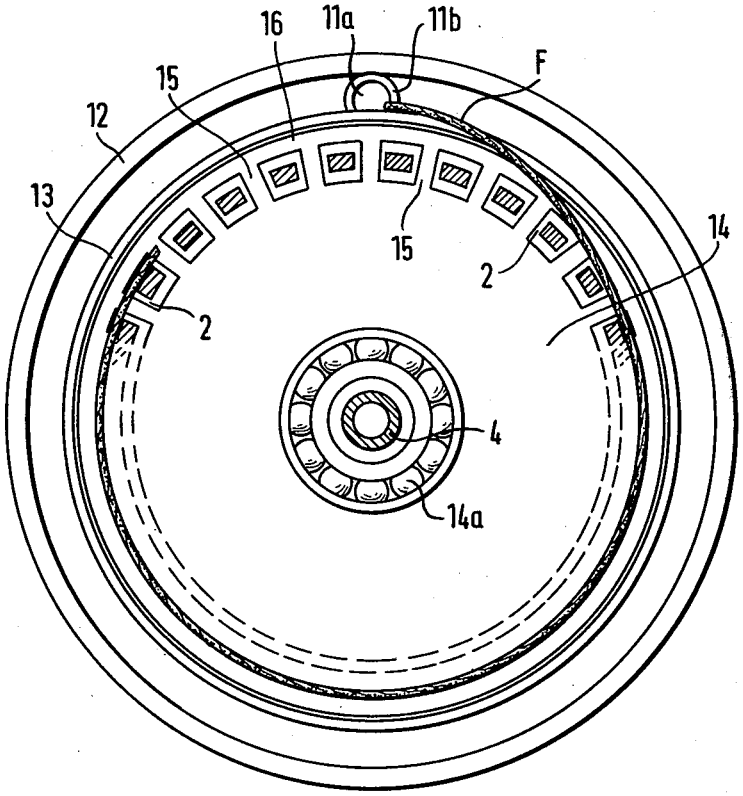
FIG. 3 is a section along the line III—III through the device shown in FIG. 1.
Figure 5:
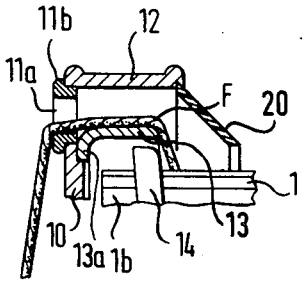
FIG. 5 shows an enlarged section of part of the device.
Figure 1:
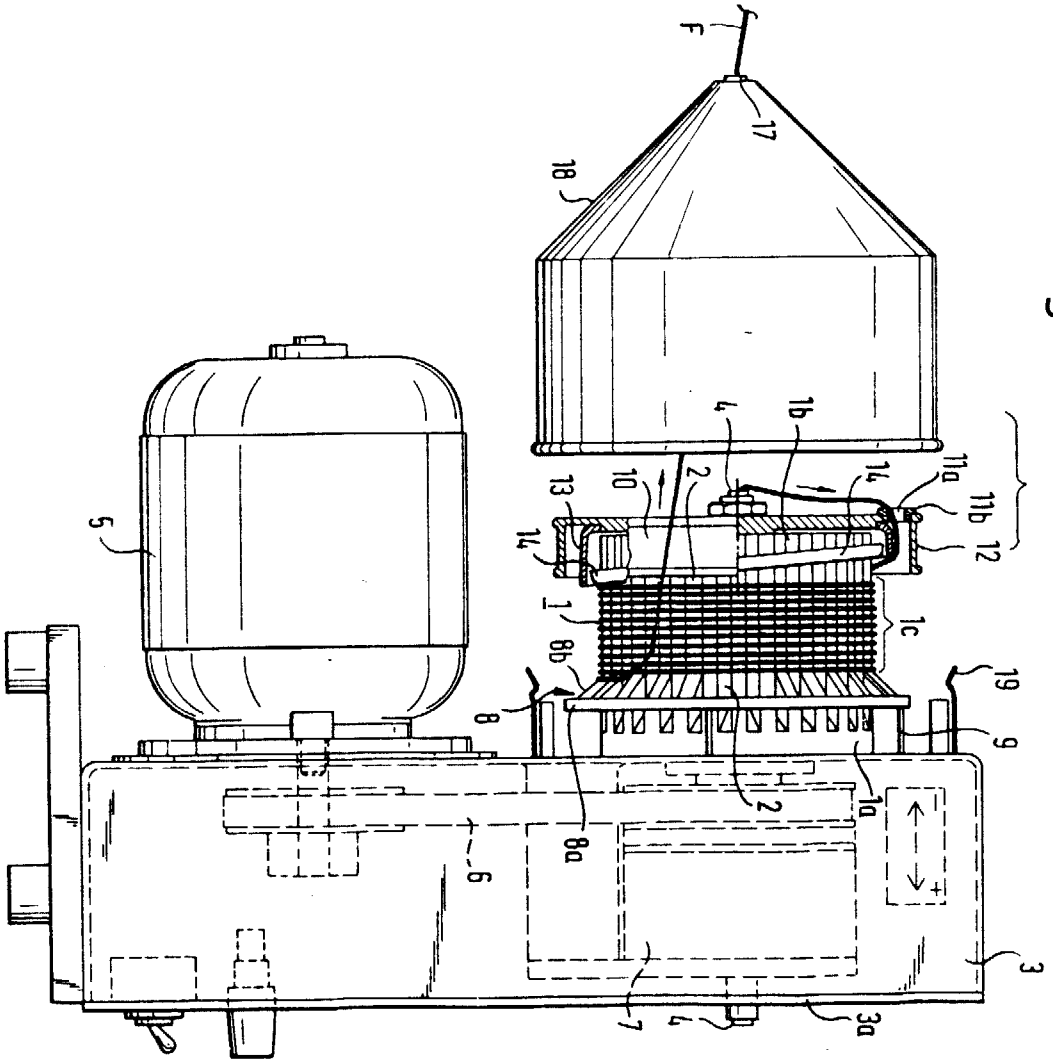
Figure 4:
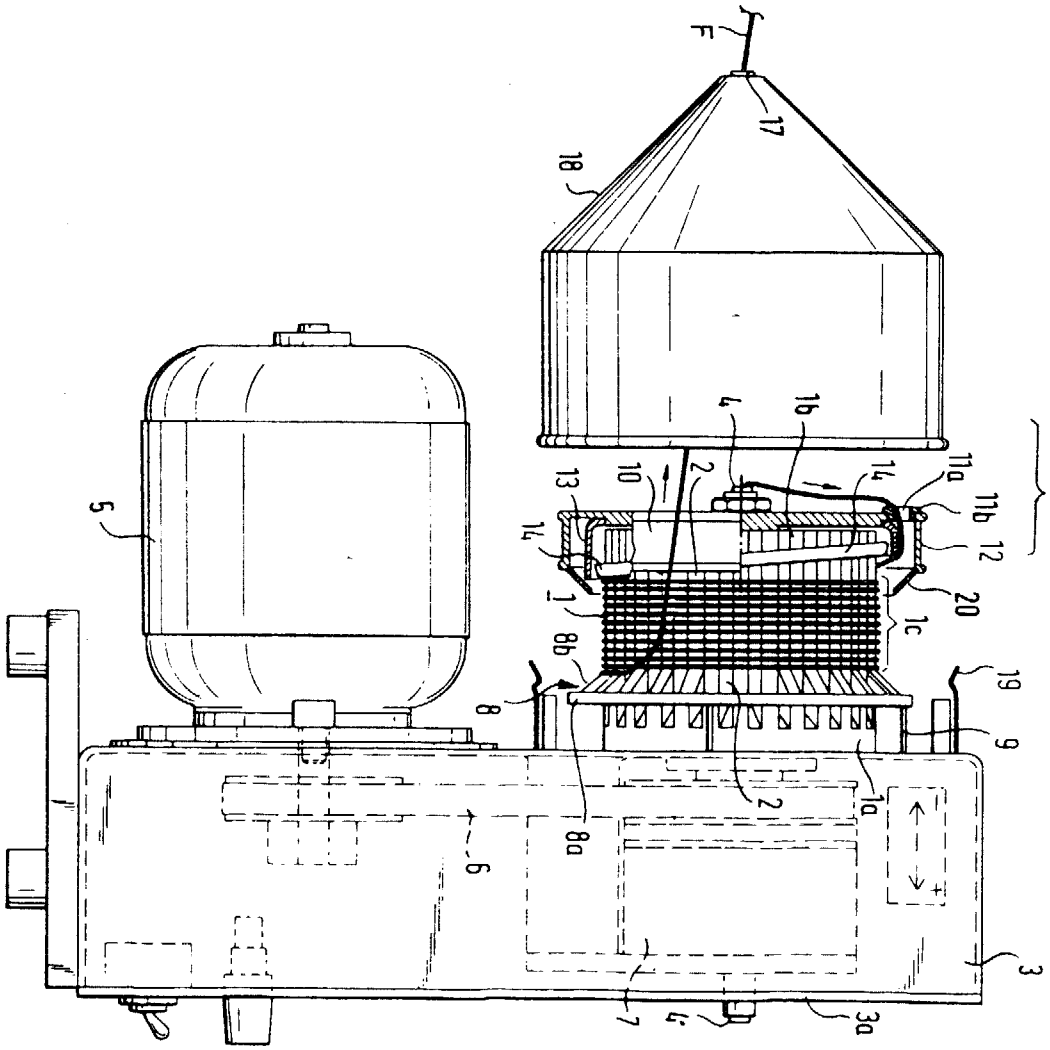

The thread delivery device shown in FIGS. 4 and 5 is substantially the same as the embodiment shown in FIGS. 1 to 3, where they have previously been described. In addition it comprises a ring 20 made of plastics material which is attached to the outer flange 12 and tapers inwardly towards the drum 1.

OPERATION

A thread F running off a storage bobbin (not shown) passes through a thread brake (also not shown) and from there into the rightward end of the hollow shaft 4. It passes out of said shaft at the second face 1*b* of the drum directed away from the housing 3, is radially diverted and fed through the thread guide 11 in a direction toward the housing. If the hollow shaft 4 is rotated and therefore also the take-up disc 10 and the thread eyelet 11*a*, the thread F is tangentially wound on to the drum 1. In this connection the annular flange 13 ensures that the thread is safely delivered to the drum section 1*c* which is provided for storing thread on the drum. Owing to its inclined position relative to the drum axis, the thrust ring 14 performs a kind of wobbling movement whereupon the thread windings formed on the drum are conveyed axially in the direction of the feeler 8 in such a manner that an intermediate supply of thread is formed on the drum. The thread is drawn off this supply in the vicinity of the feeler 8, namely in the direction of and over the flange 12 of the take-up disc 10, through the opening 17 and thence to the working elements of the textile machine. When changes in tension occur, for example at the beginning or end of the unwinding operation, the unwinding thread can execute swerving or deflecting movements even in the direction of the drum. In this case the annular flange 13 prevents the thread from being thrown into the intermediate space between the take-up disc 10 and the drum section 1*c* provided for thread storage. The protective ring 20 of the embodiment shown in FIGS. 4 and 5 ensures moreover that the unwinding thread cannot become entangled with the thread being taken up. The feeler 8 controls the size of the intermediate thread supply on the drum. If the supply is too small, the ring 8*a* and supports 9 are moved as a result of spring-loading in the direction of the second face 1*b* of the drum with such force that the micro-switch provided in the housing 3 closes the circuit to the electromagnetic clutch 7, thereby initiating rotation of the hollow shaft 4 and therefore also of the take-up disc 10 so that additional thread is wound onto the drum. In the opposite case when the intermediate thread supply on the drum exceeds an upper limit, the ring 8*a* is moved towards the housing until the micro-switch breaks the circuit to the electromagnetic clutch, thereby stopping rotation of the hollow shaft 4 and take-up disc 10.

The invention is not limited to these embodiments. For example, the annular flange can end in a straight plane instead of in an inclined plane.

In particular it should be stressed that an annular flange according to the invention can be used not only on thread delivery devices for intermittent thread delivery, but also on thread delivery devices with positive thread delivery.

What I claim is:

1. In a thread delivery device, preferably for textile machines, having a fixed drum with a rotatable hollow shaft whereby a thread from a storage bobbin is delivered from a first end face of the drum through the shaft to a second end face of the drum, a thread take-up member in the form of a circular take-up disc rigidly mounted on the rotatable hollow shaft adjacent said second end face for the tangential winding of an intermediate supply of thread on to the drum, a thrust ring surrounding said drum for controlling the thread intermediate supply and moving it in the direction toward the first end face of the drum where the thread is drawn off the drum in the direction of and over the second end face and fed to the working elements of the textile machine, the take-up disc having a thread guide in the vicinity of its edge, the improvement comprising an entire annular flange arranged on the take-up disc on the inside of the thread guide, said flange being substantially perpendicular to said disc and projecting towards the drum, said flange being concentric with a section of said drum which is positioned adjacent to the second end face.

2. A device according to claim 1, wherein the annular flange has an intermediate section which partially overlaps the opening of the thread guide.

3. A device according to claim 2, wherein the intermediate section is rounded.

4. A device according to claim 1, wherein the thrust ring is inclined relative to the drum axis for controlling the intermediate thread supply, said annular flange having an internal diameter slightly greater than the external diameter of the thrust ring.

5. A device according to claim 4, wherein the annular flange projects axially over the thrust ring at all points.

6. A device according to claim 5, wherein the free edge of the annular flange is limited by an end face which is inclined to correspond to the inclined position of the thrust ring.

7. A device according to claim 1, wherein the take-up disc is provided, along its entire circumference, with an annular outer flange extending perpendicular thereto and towards the drum, and wherein the edge of the outer flange directed away from the take-up disc supports an inwardly tapering protective ring.

8. A device according to claim 7, wherein said annular flange has an internal diameter slightly greater than the external diameter of said thrust ring.

9. A device according to claim 8, wherein said annular flange projects axially over the thrust ring at all points.

* * * * *

UNITED STATES PATENT OFFICE
CERTIFICATE OF CORRECTION

Patent No. 3,993,258 Dated November 23, 1976

Inventor(s) Karl Arne Gunnar Jacobsson

It is certified that error appears in the above-identified patent and that said Letters Patent are hereby corrected as shown below:

On the cover sheet, the illustrated figure should appear as figure 1.

Figures 1 and 4 should appear as shown on the attached sheet.

Signed and Sealed this

Eighth Day of March 1977

[SEAL]

*Attest:*

RUTH C. MASON
*Attesting Officer*

C. MARSHALL DANN
*Commissioner of Patents and Trademarks*

UNITED STATES PATENT OFFICE

CERTIFICATE OF CORRECTION

Patent No. 3,993,258 Dated November 23, 1976

Inventor(s) Kurt Arne Gunnar Jacobsson Page 1 of 3

It is certified that error appears in the above-identified patent and that said Letters Patent are hereby corrected as shown below:

On the cover sheet, the illustrative Figure should appear as Figure 1.

Figures 1 and 4 should appear as shown on the attached sheets.

This certificate supersedes Certificate of Correction issued March 8, 1977.

Signed and Sealed this

Tenth Day of May 1977

[SEAL]

*Attest:*

RUTH C. MASON
*Attesting Officer*

C. MARSHALL DANN
*Commissioner of Patents and Trademarks*

UNITED STATES PATENT OFFICE

CERTIFICATE OF CORRECTION

Patent No. 3,993,258 Dated November 23, 1976

Inventor(s) Kurt Arne Gunnar Jacobsson

It is certified that error appears in the above-identified patent and that said Letters Patent are hereby corrected as shown below:

Fig.1

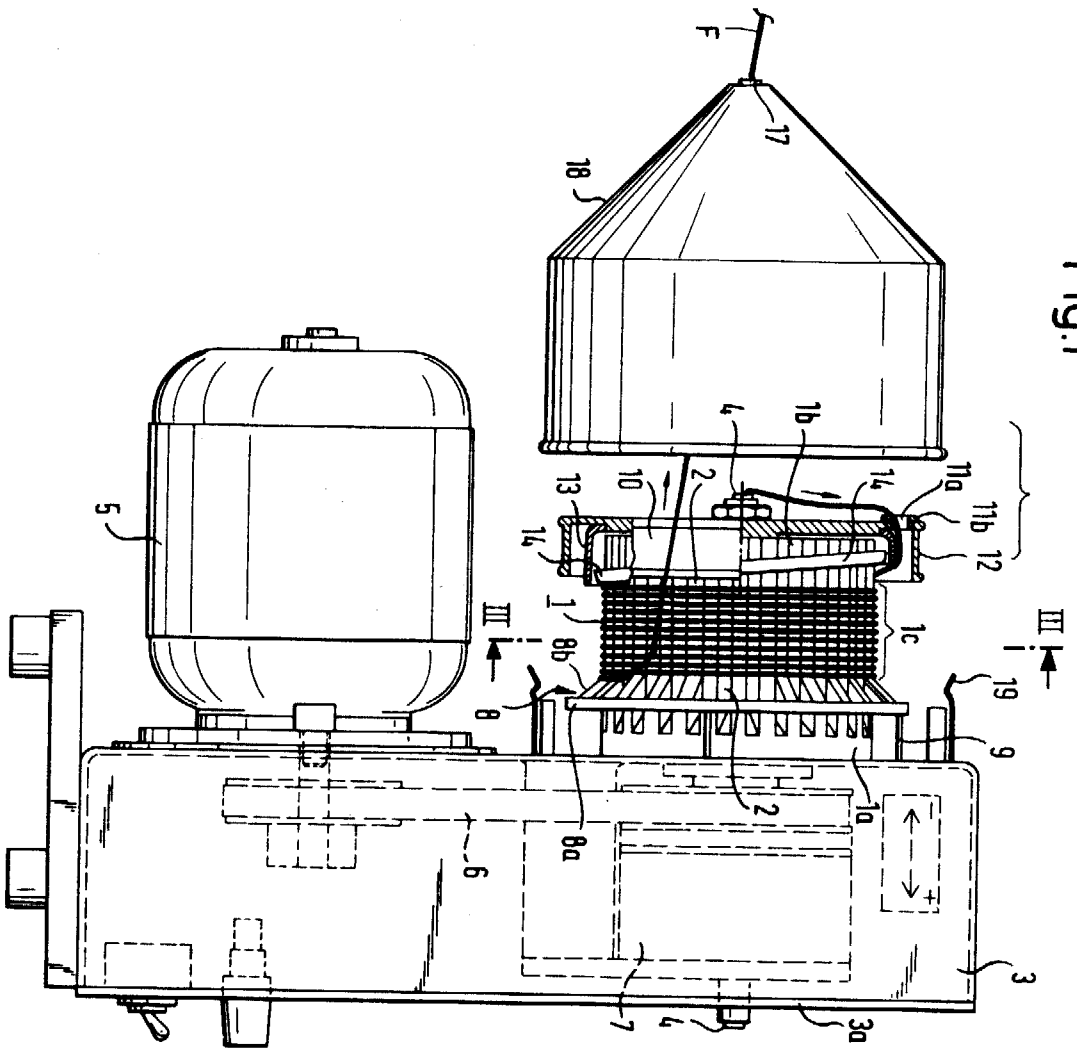

UNITED STATES PATENT OFFICE

CERTIFICATE OF CORRECTION

Patent No. 3,993,258 Dated November 23, 1976

Inventor(s) Kurt Arne Ginnar Jacobsson Page 3 of 3

It is certified that error appears in the above-identified patent and that said Letters Patent are hereby corrected as shown below:

Fig.4

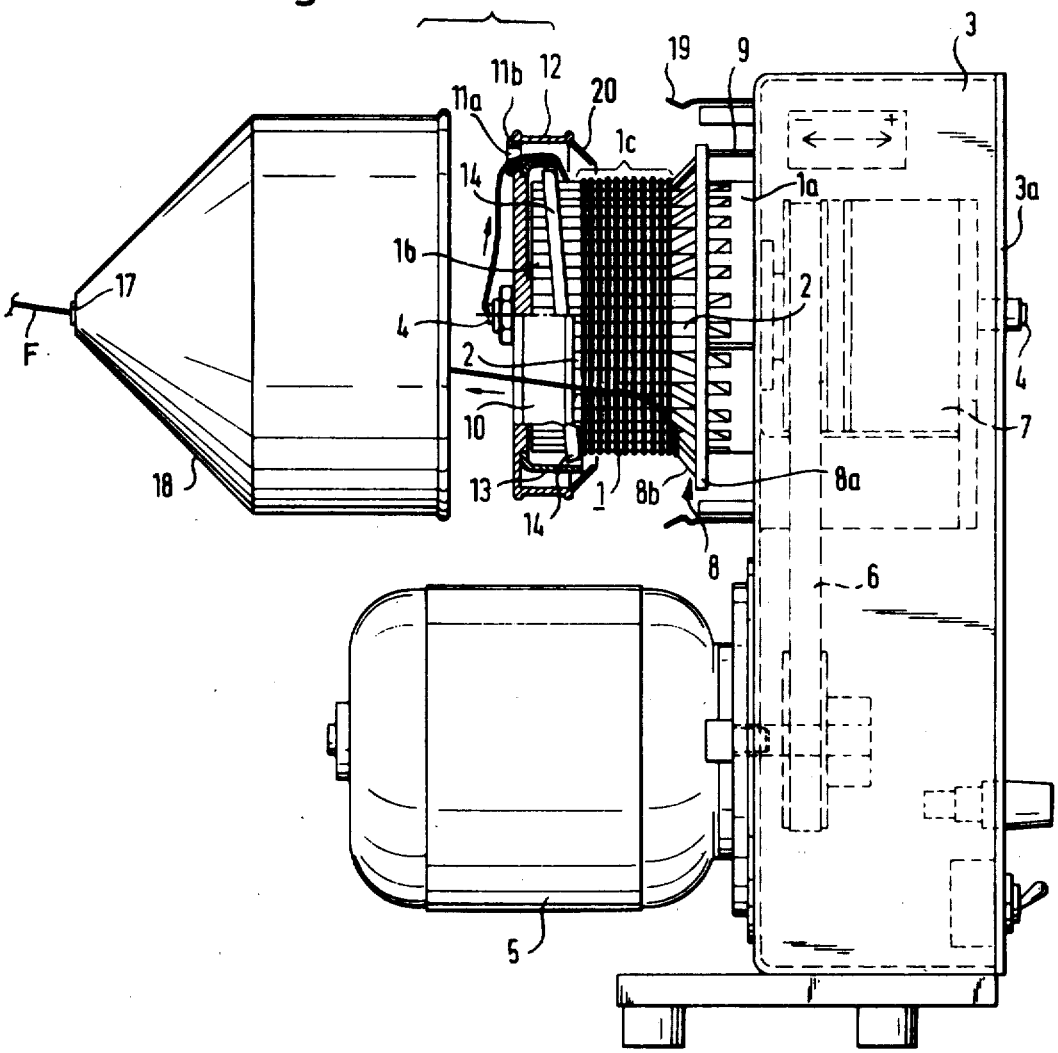

UNITED STATES PATENT OFFICE

CERTIFICATE OF CORRECTION

Patent No. 3,993,258 Dated November 23, 1976

Inventor(s) Kurt Arne Gunnar Jacobsson

It is certified that error appears in the above-identified patent and that said Letters Patent are hereby corrected as shown below:

Figure 1 should appear as shown on the attached sheet.

This certificate supersedes Certificate of May 10, 1977.

Signed and Sealed this

*second* Day of *August 1977*

[SEAL]

*Attest:*

RUTH C. MASON
*Attesting Officer*

C. MARSHALL DANN
*Commissioner of Patents and Trademarks*

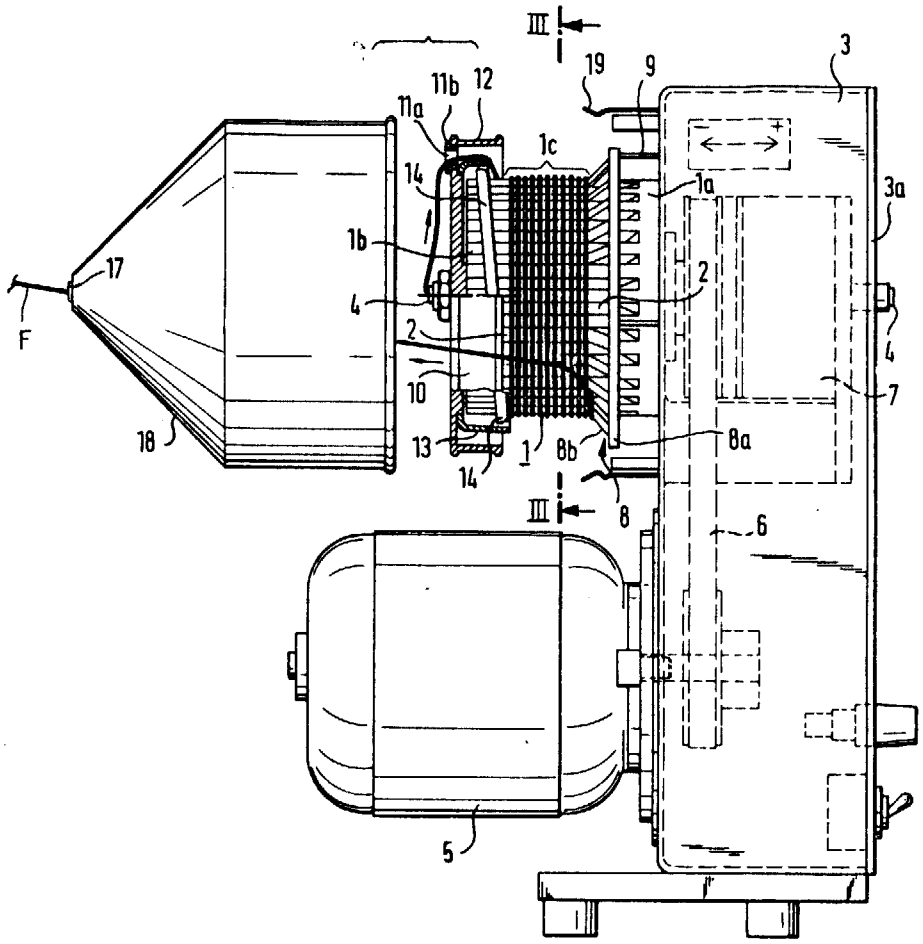
3
3a
4
7
6
8a
1a
2
9
19
III
1c
12
11b
11a
14
1b
4
2
10
13
14
1
8b
8
III
5
18
17
F